US006733550B1

(12) United States Patent
Grundy et al.

(10) Patent No.: US 6,733,550 B1
(45) Date of Patent: May 11, 2004

(54) FUEL OIL COMPOSITION

(75) Inventors: Michael John Grundy, Chester (GB); Michael Pearson, Malpas (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/040,911

(22) Filed: Mar. 18, 1998

(30) Foreign Application Priority Data

Mar. 21, 1997 (EP) ..... 97301931

(51) Int. Cl.[7] ..... C10L 1/22
(52) U.S. Cl. ..... 44/348
(58) Field of Search ..... 44/347, 348

(56) References Cited

U.S. PATENT DOCUMENTS

| | | | | |
|---|---|---|---|---|
| 5,478,367 A | | 12/1995 | Sexton et al. | 44/35 |
| 5,484,462 A | | 1/1996 | Herbstman | 44/334 |
| 5,490,864 A | | 2/1996 | Herbstman et al. | 44/379 |
| 5,833,721 A | * | 11/1998 | Hart | 44/347 |

FOREIGN PATENT DOCUMENTS

| | | | | |
|---|---|---|---|---|
| EP | 0147240 B1 | | 4/1989 | C10L/1/22 |
| EP | 0482253 A1 | | 4/1992 | C10L/1/22 |
| EP | 0557561 A1 | | 9/1993 | H04L/25/49 |
| EP | 0613938 A1 | | 9/1994 | C10L/1/22 |
| GB | 960493 | | 6/1964 | |
| WO | 94/17160 | | 8/1994 | C10L/1/18 |
| WO | 94/20593 | | 9/1994 | C10L/1/22 |
| WO | 95/33805 | | 12/1995 | C10L/1/22 |
| WO | WO 96/01854 | * | 1/1996 | |
| WO | 96/23855 | | 8/1996 | C10L/1/14 |

OTHER PUBLICATIONS

Wilson, Bill , Industrial Lubrication and Tribology, "Fuel Lubricity", vol. 48, No. 1, Jan.–Feb. 1996, pp. 10–14.*

* cited by examiner

*Primary Examiner*—Margaret B. Medley

(57) ABSTRACT

The invention provides a fuel oil composition comprising a major proportion of liquid hydrocarbon middle distillate fuel oil having a sulphur concentration of at most 0.05% by weight, and a minor proportion of a dispersant additive obtained by reacting, in a molar ratio A:B in the range 4:3 to 1:10, (A) a polyalkenyl derivative of monoethylenically unsaturated $C_4$–$C_{10}$ dicarboxylic acid material in which the number average molecular weight ($M_n$) of the polyalkenyl chain is in the range from 850 to 1150 with (B) a polyamine of general formula $$H_2N(CH_2)_m—[NH(CH_2)_m]_n—NH_2 \quad (1)$$

where m is in the range from 2 to 4 and n is in the range from 1 to 6; a process for the preparation of such a fuel composition, and a method of operation a compression-ignition engine with enhance injector cleanliness using such a fuel oil composition.

9 Claims, No Drawings

FUEL OIL COMPOSITION

FIELD OF THE INVENTION

The present invention relates to fuel oil compositions, processes for their preparation, and their use in compression-ignition engines.

BACKGROUND OF INVENTION

As stated in WO 95 33805 (Exxon) environmental concerns have led to a need for fuels with reduced sulphur content, especially diesel fuel and kerosene. However, the refining processes that produce fuels with low sulphur contents also result in a product of lower viscosity and a lower content of other components in the fuel that contribute to its lubricity, for example, polycyclic aromatics and polar compounds. Furthermore, sulphur-containing compounds in general are regarded as providing anti-wear properties and a result of the reduction in their proportions, together with the reduction in proportions of other components providing lubricity, has been an increase in reported failures of fuel pumps in diesel engines using low-sulphur fuels, the failure being caused by wear in, for example, cam plates, rollers, spindles and drive shafts.

This problem may be expected to become worse in future because, in order to meet stricter requirements on exhaust emissions generally, high pressure fuel pumps, for example rotary and unit injector systems, are being introduced, these being expected to have more stringent lubricity requirements than present equipment, at the same time as lower sulphur levels in fuels become more widely required.

At present, a typical sulphur content in a diesel fuel is about 0.25% by weight (2500 ppmw). In Europe maximum sulphur levels have been reduced to 0.05% (500 ppmw), in Sweden grades of fuel with levels below 0.005% (50 ppmw) (Class 2) and 0.001% (10 ppmw) (Class 1) are already being introduced.

In the context of this specification low-sulphur fuels are those having a sulphur level below 0.05% by weight (500 ppmw)

Many additives have been described over the years for enhancing engine cleanliness, e.g. for reducing or removing deposits in the intake system (e.g. carburetors, intake manifold, inlet valves) or combustion chamber surfaces of spark-ignition engines, or for reducing or preventing injector nozzle fouling in compression-ignition engines For example, UK Patent Specification No. 960,493. (California Research Corporation) published Jun. 10, 1964, describes the incorporation of metal-free detergents, in the form of polyolefin substituted succinimides of tetraethylene pentamine, in base fuels for internal combustion engines. The succinimides disclosed correspond to the general formula:

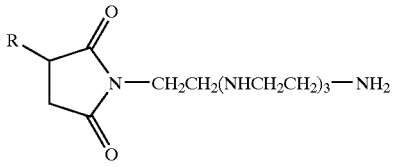

wherein R is derived from a polymer RH of an olefin containing from 2 to 5 carbon atoms, which polymer contains from 30 to 200 carbon atoms. The molecular weight of the radical R is said to range from 400 to 3000, more preferably, 900 to 1200 and is advantageously derived from a polymer of isobutene having a molecular weight of about 1000. The single example of the preparation of such a succinimide is based on polysibotuylene of molecular weight about 1000, and tests are described using the resulting succinimide in gasoline and in a high-sulphur diesel fuel (sulphur content of 0.5% w, i.e. 5,000 ppmw).

More recent publications, e.g. those dating from after expiry of UK Patent No. 960,493 and its equivalents, teach the use of somewhat different succinimides and other succinic acid derivatives in fuel compositions Thus, EP-B-147 240 (Ethyl) describes a distillate fuel composition for indirect injection compression ignition engines containing in an amount sufficient to suppress and preferably to minimise coking in nozzles of indirect injection compression ignition engines operated on such fuel a combination of (a) organic nitrate ignition accelerator and (b) hydrocarbyl-substituted succinimide or succinamide, and optionally: (c) hydrocarbyl amine having from 3 to 60 carbons and from 1 to 10 nitrogens, or a combination of the hydrocarbyl amine (c) and (d) N,N'-disalicylidene-1,2-diaminopropane. The hydrocarbyl-substituted succinimide is preferably an olefin-polymer substituted succinimide wherein the olefin polymer substituent has an average molecular weight of 500–500,000, preferably being a polyisobutene substituent having an average molecular weight of 700–5,000. The succinimide portion is preferably derived from a polyalkyleneamine of formula $H_2N—(R—NH)_n—H$ wherein R is a divalent aliphatic hydrocarbon having 2 to 4 carbon atoms and n is an integer from 1 to 10, including mixtures thereof, and the polyalkyleneamine is preferably a polyethyleneamine having 2 to 6 ethylene units. The most preferred succinimide-succinamide component is the commercial product "HITEC E-644" (trade mark), which is used in the examples and is described as being "made by reacting two moles of a polyisobutenyl succinic anhydride with one mole of a polyethylene amine mixture having an average composition corresponding to tetraethylene pentamine" (Page 7, lines 4 to 6). The base fuel used in the examples was a high-sulphur fuel (sulphur content of 0.41%w, i.e. 4,100 ppmw).

EP-A-482 253 (Ethyl) describes a fuel composition which comprises a liquid middle distillate hydrocarbonaceous fuel containing at least one fuel-soluble ashless dispersant in an amount of at least 50 ppm sufficient to cause a prompt reduction in emissions released upon combustion of said fuel composition. In the example, the ashless dispersant is described as "a polyisobutenyl succinimide of tetraethylene pentamine in which the number average molecular weight of the polyisobutenyl group is about 950, used as a 75% solution in high aromatic solvent" (Page 10, lines 11 to 13), and the base fuel was a high-sulphur fuel (sulphur content of 0.125%w (Page 10, line 27), i.e. 1,250 ppmw). The general description relating to succinimides of ethylene polyamines including tetraethylene pentamine simply states "these ethylene polyamines have a primary amine group at each end so can form mono-alkenylsuccinimides and bis-alkenylsuccinimides" (Page 3, lines 9 and 10). No distinction or preference is expressed as between mono- and bis-succinimides.

EP-A-613 938 (BP) describes hydrocarbon fuel compositions comprising a hydrocarbon fuel and a hydrocarbyl succinic diamide derived from a secondary amine. The hydrocarbon fuel "may suitably comprise a hydrocarbon fraction boiling in the gasoline range or a hydrocarbon fraction boiling in the diesel range" (Page 5 lines 10 and 11). There is no discussion of sulphur content. The engine tests in the examples are in an Open Kadett engine (clearly a spark-ignition engine) and as comparative examples there are used (1) a mono-succinimide derived from a polyisobutylene succinic anhydride of PIB Mn about, 1000 and tetraethylene pentamine and (2) a bis-succinimide derived from the same polyisobutylene succinic anhydride and triethylene tetramine. The mono-succinimide gave results which were significantly inferior to the bis-succinimide (deposits mg/valve of 229 compared with 40, valve rating of 8.0 compared with 9.70) (Page 9, Table 2).

EP-B-557 561 (Chevron) discloses fuel compositions comprising a major amount of hydrocarbons boiling in the gasoline or diesel range and an effective detergent amount of an additive composition comprising:

(a) a polyisobutenyl succinimide having the formula

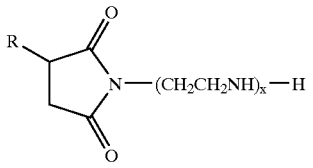

wherein R is a polyisobutenyl group having a number average molecular weight in the range of 1200 to 1500, preferably 1200 to 1400, more preferably 1250 to 1350, and most preferably about 1300, and x is 1 or 2, and (b) a nonvolatile paraffinic or naphthenic carrier oil, or a mixture thereof. It is stated (Page 3, lines 8 to 12) that the invention therein "is based on the surprising discovery that the unique combination of a polyisobutenyl succinimide and a carrier oil, wherein the polyisobutenyl succinimide is derived from ethylenediamine or diethylenetriamine and the polyisobutenyl group has an average molecular weight of 1200 to 1500, provides unexpectedly superior deposit control performance when compared to prior art polyisobutenyl succinimides of lower molecular weight". There is no discussion of sulphur content of the fuel. The deposit control tests in the examples are in gasoline, and as comparative examples there are described monosuccinimides (PIB Mn 950) of ethylenediamine (Example 1) and of diethylenetriamine (Example 2). These are shown to give significantly inferior intake value deposit weights (Average 127.9 and 105.2 mg, respectively) compared with the directly equivalent materials derived from PIB of Mn 1300 (Average 72.2 and 35.1 mg, respectively).

U.S. Pat. No. 5,478,367 (ass. Exxon) discloses diesel fuel compositions containing certain macrocyclic polyamines derived from reaction of polyisobutylene succinic anhydride with certain polyamines, for reduction of particulate emissions on combustion. The diesel fuel used in the examples was a high-sulphur fuel (sulphur content of 0.23%w, i.e. 2,300 ppmw) The macrocyclic polyamines were characterised by their IR spectra having four peaks between 1900 and 1500 wave numbers This is contrasted with the IR spectra of uncyclised equivalents, which only have three peaks in this region (Column 9, lines 16 to 22).

WO 94 20593 (Mobil) discloses a low emission diesel fuel having a cetane number in the range of 50 to 60, which comprises:

(i) a straight run hydrocarbon distillate having an initial boiling point in the range of 170° C. to 190° C., an end point not higher than 315° C., a sulphur content of less than 0.1 wt percent (preferably sulphur content from 0.005 to 0.05%w, i.e. 50 to 500 ppmw) and aromatics content of 18 to 30 wt. percent, a maximum specific gravity of 0.83 at 15° C. and an API gravity of 38 to 43, and (ii) an additive package comprising a detergent, a friction reducing additive and a cetane number improver. In the examples, two base fuels are used, one of sulphur content 0.01%w (100 ppmw) and one of 0.06%w (600 ppmw). The polyisobutylene succinimide detergent used in the examples is not specifically identified, but the general description does specifically state (Page 6, lines 10 to 14) that a "preferred detergent is a polybutenyl bis(succinimide) produced from a polybutenyl succinic anhydride and tetraethylene pentamine (2:1 ratio, pb mol. wt. about 1200) in combination with ethylene diamine tetraacetic acid".

WO 9623855 (Exxon) discusses in detail the lubricity problems of low-sulphur diesel fuels and discloses a fuel oil composition comprising a major amount of a fuel oil containing not more than 0.05% by weight of sulphur (i.e. 500 ppmw) and having a 95% distillation point of not greater than 350° C., and a minor amount of an additive composition comprising:

(a) an ashless dispersant comprising an acylated nitrogen compound, and (b) a carboxylic acid, or an ester of the carboxylic acid and an alcohol wherein the acid has from 2 to 50 carbon atoms and the alcohol has one or more carbon atoms. Preferred acylated nitrogen compounds are those made by reacting a polyisobutenyl succinic anhydride with mixtures of ethylene polyamines. In the examples, the ashless dispersant employed is described as a "succinimide ashless dispersant being the reaction product of 1.5 equivalents of PIBSA (polyisobutyl succinic anhydride, with polyisobutylene number average molecular weight of approximately 950, as measured by Gel Permeation Chromatography) with one equivalent of polyethylene polyanine mixture of average composition approximating to pentaethylene hexamine". High frequency reciprocating rig test data are given for this ashless dispersant in a low-sulphur diesel fuel of sulphur content 0.05%w (500 ppmw) together with, as (b), a "reaction product of equimolar amounts of ethylene glycol and dilinoleic acid, subsequently reacted with methanol, being a mixture of esters", and in a low-sulphur diesel fuel of sulphur content 0.03% w (300 ppmw ) together with this same reaction product and, as an alternative (b), with "a commercial mixture of dimer fatty acids, predominantly dilinoleic acid". Further examples employ a low-sulphur diesel fuel of sulphur content 0.00045% (4.5 ppmw) and are filterability tests using this ashless dispersant together with, as (b), ether a sorbitan mono-oleate ester or a glycerol mono-oleate ester.

There are numerous patents relating to lubricity improvers for low-sulphur diesel fuels, developed in the light of the paper by Danping Wei and H. A. Spikes. "The Lubricity of Diesel Fuels". Wear, III(1986) 217–235, for example those following.

WO 95 33805 (Exxon) describes the use of cold flow improvers to enhance lubricity of lowy-sulphur fuels.

WO 94 17160 (Exxon) describes the use of certain esters of a carboxyclic acid and an alcohol wherein the acid has from 2 to 50 carbon atoms and the alcohol has one or more carbon atoms, particularly glycerol monooleate and di-isodecyl adipate, as additives for fuel oils for wear reduction in the injection system of a compression-ignition engine.

U.S. Pat. No. 5,484,462 (Texaco) mentions dimerized linoleic acid as a commercially available lubricity agent for low sulphur diesel fuel (Col. 1, line 38), and itself provides aminoalkylmorpholines as fuel lubricity improvers.

U.S. Pat. No. 5,490,864 (Texaco) describes certain dithiophosphoric diester-dialcohols as anti-wear lubricity additives for low-sulphur diesel fuels.

The present Applicant's European Patent Application No 96304975.4, filed Jul. 5, 1996, (Applicant's ref. TS 7520 EPC) discloses that certain alkyl aromatic compounds having at least one carboxyl group attached to their aromatic nuclei can confer anti-wear lubricity effects when incorporated in fuel oil, especially low-sulphur diesel fuel. The alkyl aromatic compounds are those wherein at least one alkyl group of 6 to 30 carbon atoms is attached to an aromatic nucleus and at least one carboxyl group and optionally one or two hydroxyl groups are attached to the aromatic nucleus Preferred alkyl aromatic compounds are alkyl benzoic acids or alkylsalicylic acids containing one or two alkyl groups, preferably of 6 to 30 carbon atoms, more preferably a $C_{8-20}$ alkyl group, advantageously a $C_{8-18}$ alkyl group.

SUMMARY OF THE INVENTION

It has now surprisingly been found that use of a certain narrow band of dispersant additives in low-sulfur diesel fuel are dramatically more effective in enhancing, injector cleanliness than closely analogous dispersant additives. Such dramatic differences are not observed and are not predictable when the various dispersant additives are used in conventional, high-sulphur, diesel fuels.

According to the present invention there is provided a fuel oil composition comprising a major proportion of a liquid hydrocarbon middle distillate fuel oil having a sulphur concentration of at most 0.05% by weight, and a minor proportion of a dispersant additive obtained by reacting, in a molar ratio A:B in the range 4:3 to 1:10. (A) a polyalkenyl derivative of monoethylenically unsaturated $C_4$–$C_{10}$ dicarboxylic acid material in which the number average molecular weight ($M_n$) of the polyalkenyl chain is in the range from 850 to 1150 with (B) a polyamine of general formula $$H_2N(CH_2)_m—[NH(CH_2)_m]_n—NH_2 \quad (1)$$

where m is in the range from 2 to 4 and n is in the range from 1 to 6.

In another aspect, the present invention provides a fuel oil composition comprising a major proportion of a liquid hydrocarbon middle distillate fuel oil having a sulphur concentration of at most 0.05% by weight and a minor amount of an additive composition comprising a dispersant additive and a lubricity additive, wherein the dispersant additive is obtained by reacting, in a molar ratio A:B in the range 4:3 to 1:10. (A) a polyalkenyl derivative of monoethylenically unsaturated $C_4$–$C_{10}$ dicarboxylic acid material in which the number average molecular weight ($M_n$) of the polyalkenyl chain is in the range from 850 to 1150 with (B) a polyamine of general formula $$H_2N(CH_2)_m—[NH(CH_2)_m]_n—NH_2 \quad (1)$$

where m is in the range from 2 to 4 and n is in the range from 1 to 6.

DETAILED DESCRIPTION OF THE INVENTION

The present invention provides a fuel oil composition comprising, a major proportion of a liquid hydrocarbon middle distillate fuel oil having a sulphur concentration of at most 0.05% by weight, and a minor proportion of a dispersant additive obtained by reacting, in a molar ratio A:B in the range 4:3 to 1:10. (A) a polyalkenyl derivative of monoethylenically unsaturated $C_4$–$C_{10}$ dicarboxylic acid material in which the number average molecular weight ($M_n$) of the polyalkenyl chain is in the range from 850 to 1150 with (B) a polyamine of general formula $$H_2N(CH_2)_m—[NH(CH_2)_m]_n—NH_2 \quad (1)$$

where m is in the range from 2 to 4 and n is in the range from 1 to 6. The present invention further provides a fuel oil composition comprising a major proportion of a liquid hydrocarbon middle distillate fuel oil having a sulphur concentration of at most 0.05% by weight and a minor amount of an additive composition comprising a dispersant additive and a lubricity additive, wherein the dispersant additive is obtained by reacting, in a molar ratio A:B in the range 4.3 to 1:10. (A) a polyalkenyl derivative of monoethylenically unsaturated $C_4$–$C_{10}$ dicarboxylic acid material in which the number average molecular weight ($M_n$) of the polyalkenyl chain is in the range from 850 to 1150 with (B) a polyamine of general formula $$H_2N(CH_2)_m—[NH(CH_2)_m]_n—NH_2 \quad (1)$$

where m is in the range from 2 to 4 and n is in the range from 1 to 6.

The middle distillate fuel oil is derived from petroleum and will typically have a boiling range in the range 100° C. to 500° C. e.g. 150° C. to 400° C. Such petroleum-derived fuel oils may comprise atmospheric distillate or vacuum distillate, or cracked gas oil or a blend in any proportion of straight run and thermally and/or catalytically cracked distillates. Preferred fuel oil compositions of the invention are diesel fuel compositions. Diesel fuels typically have initial distillation temperature about 160° C. and final distillation temperature of 290–360° C., depending on fuel grade and use.

The fuel oil itself may be an additised (additive-containing) oil or an unadditised (additive-free) oil. If the fuel oil is an additised oil, it will contain minor amounts of one or more additives e.g. one or more additives selected from anti-static agents, pipeline drag reducers, flow improvers (e.g. ethylene/vinyl acetate copolymers or acrylate/maleic anhydride copolymers) and wax anti-settling agents (e.g. those commercially available under the Trade Marks "PARAFLOW" (e.g. "PARAFLOW" 450; ex Paramins). "OCTEL" (e.g. "OCTEL" W 5000; ex Octel) and "DODIFLOW" (e.g. DODIFLOW" v 3958; ex Hoechst).

The fuel oil has a sulphur content of at most 0.05% by weight (500 ppmw) ("ppmw" is parts per million by weight) Advantageous compositions of the invention are also attained when the sulphur content of the fuel oil is below 0.005% by weight (50 ppmw) or even below 0.001% by weight (10 ppmw).

The polyalkenyl derivatives of monoethylenically unsaturated $C_4$–$C_{10}$ dicarboxylic acid material are known compounds or can be prepared by processes analogous to known processes Thus, such a derivative may conveniently be prepared by mixing a polyalkene with a specified amount of a monoethylenically unsaturated $C_4$–$C_{10}$ dicarboxylic acid material and passing chlorine through the mixture, e.g. as described in GB-A-949,981. Alternatively, the derivative may be prepared by reacting thermally at an appropriate temperature the polyalkene with a specified amount of the dicarboxylic acid material, e.g. as described in GB-A-1,483,729. A particularly advantageous process for preparing the derivative involves reacting the polyalkene with the dicarboxylic acid material in mol ratio dicarboxylic acid material polyalkene greater than 1:1, at a temperature in the range 150 to 260° C., if desired in the presence of a polyaddition-inhibiting amount of a sulphonic acid, as described in EP-A-542,380.

The polyalkene may conveniently be a homopolymer or copolymer, for example of at least one $C_2$–$C_{10}$ monoolefin. Preferably the polyalkene is a polymer of at least one $C_2$–$C_5$ monoolefin, e.g. an ethylene-propylene copolymer. The monoolefin is preferably a $C_3$–$C_4$ olefin and preferred polyalkenes derived therefrom include polyisobutylenes and atactic or isotactic propylene oligomers.

The monoolefin is most preferably isobutylene, so polyisobutylenes are the preferred form of polyalkene. Examples of suitable commercial polyisobutylenes are those sold by BP under the trade marks "HYVIS 10", "NAPVIS 10" and "ULTRAVIS 10", that sold by Exxon under the trade mark "PARAPOL 950", that sold by BASF under the trade mark "GLISSOPAL 1000" and that sold by Amoco under the trade mark "INDOPOL H 100".

The number average molecular weight, $M_n$, of polyalkenes may be determined by several techniques which give closely similar results. Conveniently, $M_n$ may be determined for examples by modern gel permeation chromatography (GPC), e.g. as described for example in W. W. Yau, J. J. Kirkland and D. D. Bly, "Modern Size Exclusion Liquid Chromatography". John Wiley and Sons, New York. 1979.

The number average molecular freight of the polyalkenyl chain is in the range from 850 to 1150, preferably 850 to 1000.

$C_4$–$C_{10}$ dicarboxylic acid materials (see for example U.S. Pat. Nos. 4,086,51 and 4,235,786) may for example be anhydrides, e.g. of $C_4$–$C_6$ dicarboxylic acids such as maleic acid, citraconic acid (methylmaleic acid), itaconic acid (methylene succinic acid) and ethylmaleic acid. The $C_4$–$C_{10}$ dicarboxylic acid material is preferably maleic anhydride.

When the $C_4$–$C_{10}$ dicarboxylic acid material is maleic anhydride, the polyalkenyl derivative will be a polyalkenyl succinic acid derivative.

The ratio of dicarboxylic acid moieties per polyalkenyl chain (referred to as "succination ratio" when the dicarboxylic acid material is maleic anhydride), r, may readily be determined by a procedure which will be described later, in the examples, "r" is preferably not greater than 1 2:1

Examples of polyamines of formula 1 above include diethylene triamine, triethylene tetramine, tetraethylene pentamine, pentaethylene hexamine, hexaethylene heptamine, tripropylene tetramine, and corresponding commercial mixtures such as "Polyamine H", "Polyamine 400" and "Polyamine S". Preferably n is in the range 1 to 3. Preferably m is 2, so the preferred polyamines are polyethyleneamines.

The molar ratio A:B is preferably less than 6:5, preferably in the range 6:5 to 1:2. Where excess polyamine is employed, unreacted amine may conveniently be removed by evaporation or by washing, e.g. with aqueous medium such as a methanol/water mixture.

The dispersant additive are generally mixtures of amide and imide species, as demonstrated by infra-red spectroscopy.

The dispersant additive is preferably present in an amount in the range of from 10 to 400 ppmw, more preferably 40 to 200 ppmw, active matter based on total composition.

Fuel oil compositions of the present invention preferably additionally contain a lubricity additive in an amount in the range from 50 to 500 ppmw based on total composition. The lubricity additive may be any lubricity additive, e.g. as described above. Commercial lubricity additives include those available as EC 831 (ex Paramins). "HITEC" (trade mark) E580 (ex Ethyl Corporation) and "PARADYNE" (trade mark) 655 (ex Exxon Chemical Ltd).

The present invention further provides a process for the preparation of a fuel oil composition according to the invention, as defined above, which comprises admixing the dispersant additive or an additive concentrate containing the dispersant additive with the fuel oil.

Additive concentrates suitable for incorporating in the fuel oil compositions will contain the dispersant additive, preferably together with the lubricity additive, and a fuel-compatible diluent, which may be a carrier oil (e.g. a mineral oil), a polyether, which may be capped or uncapped, a non-polar solvent such as toluene, xylene, white spirits and those sold by member companies of the Royal Dutch/Shell Group under the Trade Mark "SHELLSOL", and/or a polar solvent such as esters and, in particular, alcohols, e.g. hexanol, 2-ethylhexanol, decanol, isotridecanol and alcohol mixtures such as those sold by member companies of the Royal Dutch/Shell Group under the Trade Mark "LINEVOL", especially "LINEVOL" 79 alcohol which is a mixture of $C_{7-9}$ primary alcohols, or the $C_{12-14}$ alcohol mixture commercially available from Sidobre Sinnova, France under the Trade Mark "SIPOL".

Additive concentrates and fuel oil compositions prepared therefrom may further contain additional additives such as dehazers, e.g. alkoxylated phenol formaldehyde polymers such as those commercially available as "NALCO" (trade mark) EC5462A (formerly 7D07) (ex Nalco), and "TOLAD" (trade mark) 2683 (ex Petrolite); anti-foaming agents (e.g. the polyether-modified polysiloxanes commercially available as "TEGOPREN" (trade mark) 5851, Q 25907 (ex Dow Corning), "SAG" (trade mark) TP-325 (ex OSi), or "RHODORSIL" (trade mark) (ex Rhone Poulene)); ignition improvers (e.g. 2-ethylhexyl nitrate, cyclohexyl nitrate, di-tertiarybutyl peroxide and those disclosed in U.S. Pat. No. 4,208,190 at Column 2, line 27 to Column 3, line 21); anti-rust agents (e.g. that commercially sold by Rhein Chemie, Mannheim, Germany as "RC 4801", a propane-1, 2-diol semiester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid), reodorants, anti-wear additives; anti-oxidants (e.g. phenolics such as 2,6-di-tert-butylphenol, or phenylenediamines such as N,N'-di-sec-butyl-p-phenylenediamine), and metal deactivators.

Unless otherwise stated, the (active matter) concentration of each additional additive in the diesel fuel is preferably up to 1 percent by weight, more preferably in the range from 5 to 1000 ppmw (parts per million by weight of the diesel fuel), advantageously 75 to 300 ppmw e.g. 95 to 150 ppmw.

The (active matter) concentration of the dehazer in the diesel fuel is preferably in the range from 1 to 20 ppmw, more preferably from 1 to 15 ppmw, still more preferably from 1 to 10 ppmw and advantageously from 1 to 5 ppmw. The (active matter) concentrations of other additives (with the exception of the ignition improver) are each preferably in the range from 0 to 20 ppmw, more preferably from 0 to 10 ppmw. The (active matter) concentration of the ignition improver in the diesel fuel is preferably in the range from 0 to 600 ppmw and more preferably from 0 to 500 ppmw. If an ignition improver is incorporated into the diesel fuel, it may conveniently be used in an amount of 300 to 500 ppmw.

The invention further provides a method of operating a compression-ignition engine which comprises introducing into the combustion chambers of said engine a fuel composition according to the invention as defined above.

EXAMPLES

The present invention will be further understood from the following illustrative examples, which are included for illustrative purposes only and are in no way intended to limit the present invention. In the following illustrative examples, the test materials were prepared as follows.

In the following description, all parts and percentages are by weight, unless stated otherwise, and temperatures are in degrees Celsius. Where abbreviations are used, they have the following meanings.

"AV" denotes acid value, and this was determined using a "Metrohm 670" (trade mark) potentiometric titrometer according to a method based upon ASTM D 664-89 with modified solvent system (75% w toluene, 12.5% w acetonitrile, 12.5% w acetic acid).

"TBN" denotes total basic nitrogen, and this was determined using a "Metrohm 670" (trade mark) potentiometric titrometer according to a method based upon ASTM D 2896 with modified solvent system (75% w toluene, 12.5% w acetonitrile, 12.5% w acetic acid).

"AM" denotes active matter content, and this was determined by separating inactive material from the desired active matter in obtained product on an aluminium oxide column using diethyl ether as eluant, and is expressed as a percentage relative to the obtained product.

"Succination ratio", r, is the ratio of succinic anhydride moieties per polyisobutenyl chain, in the reaction product from reaction of polyisobutenyl with maleic anhydride, and is calculated from the following expression:

$$r = \frac{M_n \times AV}{20 \times AM - AV \times M_{DA}}$$

in which:

$M_n$=Number average molecular weight of the polyalkene

AV=Acid value of the reaction product (meq/g)

AM=Active matter in the reaction product (%w)

$M_{DA}$=Molecular weight of the dicarboxylic acid material (98 for maleic anhydride) Other abbreviations will be clear from their context.

Values given for $M_n$ herein are determined by gel permeation chromatography, e.g. as described in W. W. Yan, J. J. Kirkland and D. D. Bly, "Modern Size Exclusion Liquid Chromatography". John Wiley and Sons, New York, 1979.

Polyisobutenyl succinic anhydride (PIBSA) materials were prepared by one of two known thermal methods. The first method (1) involved reaction of polyisobutylene (PIB) with maleic anhydride (MALA) in mol ratio PIB:MALA of 1:1.5 for 6 hours in an autoclave under pressure. Unreacted MALA was then removed by vacuum distillation. The residue was diluted with about 20% w mineral oil ("HVI 60" base oil—a bright and clear high viscosity index base oil having viscosity at 100° C. of 4.4 to 4 9 $mm^2/s$ (ASTM D 445)) and filtered to remove insoluble material. The second method (2) involved heating PIB with stirring to 210° C. in a three-necked flask equipped with a condenser and overhead stirrer. MALA was added over 30 minutes to a final mol ratio PIB:MALA of 1:3, and the resulting mixture was stirred at 210° C. for 8 hours. Unreacted MALA was removed by vacuum distillation, the residue was diluted with n-heptane. filtered to remove insoluble material, and evaporated under vacuum to remove the n-heptane.

Details of PIBSA materials prepared by these methods and used in the preparation of dispersant additive test materials are given in Table 1 following

TABLE 1

| PIBSA | A | B | C | D | E | F | G |
|---|---|---|---|---|---|---|---|
| PIB $M_n$ | 950 | 884 | 950 | 780 | 570 | 350 | 1300 |
| Preparation Method | 1 | 2 | 2 | 2 | 2 | 2 | 2 |
| AV (meq/g) | 1.2 | 1.05 | 0.9 | 1.04 | 1.85 | 4.3 | 0.46 |
| AM (% w) | 56.8 | 52 | 42.8 | 38.2 | 51.4 | 77 | 41.4 |
| Succination ratio, r | 1.1:1 | 1.0:1 | 1.1:1 | 1.23:1 | 1.25:1 | 1.35:1 | 0.77:1 |

Dispersant additive test materials there prepared according to one or other of the following procedures Method A (with reference to Test Material 1 of Table 2 below)

Into a three-necked flask equipped with an overlead mechanical stirrer, Dean and Starks trap, reflux condenser and thermometer was introduced a solution of tetraethylenepentamine (TEPA) (34.7 g, 0.184 mol) in xylene (150 ml) The solution was stirred and heated in an oil-bath to 90° C. and a solution of polyisobutenylsuccinic anhydride (PIBSA A) (233 g, 0.125 mol at 56.8% active matter) in xylene (200 ml) was added dropwise over 1.5 hours. After addition was complete, the reaction mixture was heated at reflux temperature for 4 hours with removal of water formed from the reaction. The amount of water collected was 2 ml (theoretical amount 2.25 ml).

The xylene solvent was removed using a rotary evaporator leaving a residue in the form of a brown oil. This oil was dissolved in 1.1 of heptane and washed with 9:1 methanol/water mixture (3×300 ml) to remove excess amine. Again the solvent was removed using the rotary evaporator to yield 264 g of desired product.

Method B (with reference to Test Material 2 of Table 2 below)

Into a three-necked flask equipped with an overhead mechanical stirrer, Dean and Stark trap, reflux condenser and thermometer was introduced polyiso-butenylsuccinic anhydride (PIBSA A) (1000 g, 0.536 mol at 56.8% active matter). This was heated to 140° C. with stirring, and TEPA (101.46 g, 0.536 mol) was added dropwise over 10 minutes. After addition was complete, the temperature of the reaction mixture was raised to 160° C. and maintained at 160° C. for 2 hours. Volatile materials were removed using a rotary evaporator to yield the desired product as 1136 g of brown liquid.

Method C (with reference to Test Material 3 of Table 2 below)

Into a three necked flask equipped with an overhead mechanical stirrer, Dean and Stark trap, reflux condenser and thermometer was introduced diethylene-triamine (DETA) (18.0 g, 0.175 mol). This was heated to 60° C. with stirring, and polyisobutenyl succinic anhydride (PIBSA B) (170 g, 0.09 mol at 52% active matter) was added. The reaction mixture was heated to 160° C. and maintained at 160° C. for a further 2 hours before cooling and dissolving in 1.1 of heptane. The solution was washed with a 9:1 methanol/water mixture (3×300 ml) to remove excess amine.

The solvent was removed using a rotary evaporator to yield the desired product as 91 g of brown oil.

Details of the resulting test materials are given in Table 2 following, in which imide, secondary amide and tertiary amide carbonyl contents are assessed by Infra-Red Spectrometry upon samples of test material dissolved in carbon tetrachloride. Imide content is calculated from the maximum absorption band near 1710 $cm^{-1}$, secondary amide content from the absorption band near 1680 $cm^{-1}$ and tertiary amide content from the absorption band near 1660 $cm^{-1}$ The dehazer was an alkoxylated phenol formaldehyde polymer dehazer available ex Nalco as "NALCO" EC5462A (formerly 7DO7) (trade mark)

The alcohol solvent was a blend of $C_{7-9}$ primary alcohols available from member companies of the Royal Dutch/Shell group as "LINEVOL 79" (trade mark).

The lubricity agent used was a synthetic ester-containing lubricity additive available ex Exxon Chemical Ltd, Fareham, UK, under the trade designation "PARADYNE 655" ("PARADYNE" is a trade mark).

For comparison purposes, additive concentrate compositions for conventional (high sulphur) diesel fuel were prepared by mixing (A) 200 pbw or (B) 250 pbw of the above dispersant solutions with 300 pbw EHN, 5 pbw of the above anti-rust agent, 5 pbw % of the above antifoaming agent, 5 pbw of the above dehazer and 25 pbw of the above alcohol solvent.

In order to prepare test fuel formulations, the various additive concentrate compositions were added to base fuel in amounts such that each "part by weight" above became 1 ppmw of fuel formulation, e.g. each fuel formulation contained 300 ppmw EHN.

TABLE 2

| Dispersant Additive Test Material | 1 | 2 | 3 | Comp. A | Comp. B | Comp. C | Comp. D | Comp. E | Comp. F | Comp. G |
|---|---|---|---|---|---|---|---|---|---|---|
| PIBSA starting Material | A | A | B | A | A | C | D | E | F | G |
| PIB Mn | 950 | 950 | 884 | 950 | 950 | 950 | 780 | 570 | 350 | 1300 |
| Amine | TEPA | TEPA | DETA | TEPA | TEPA | DAP | TEPA | TEPA | DETA | TEPA |
| Coupling ratio - intake (mol PIBSA:mol amine) | 1:1.45 | 1:1 | 1:1.95 | 1.5:1 | 2:1 | 1:1.4 | 1:1.1 | 1:1.2 | 1:1.4 | 1:1 |
| Preparation Method | A | B | C | B | B | B | A | A | B | A |
| Yield (AM) (%) | 60.2 | 57.8 | 52.9 | 78 | 56 | 45.2 | 39.5 | 51.9 | 83.6 | 41.7 |
| TBN (found) (%) | 2.8 | 2.23 | 1.1 | 1.95 | 1.04 | 0.64 | 2.1 | 2.95 | 4.6 | 2.8 |
| IR carbonyl peaks ($cm^{-1}$) | 1770.6<br>1704.3<br>1667.9 | <br>1704<br>1665 | 1770.6<br>1704.3 | | 1771.0<br>1699.0<br>1652.0 | 1774.3<br>1706.5 | 1772.6<br>1705.0<br>1668.9 | 1771.4<br>1704.6<br>1667.9 | 1770.6<br>1699.4<br>1650.8 | 1771.0<br>1704.5<br>1661.3 |
| C—O (mmol/g) | 0.93 | 1 | 1.05 | 1.46 | 0.99 | 0.81 | 1.16 | | 3.69 | 1.27 |
| Imide | 0.46 | 0.48 | 0.4 | 0.98 | 0.55 | 0.72 | 0.76 | | 0.58 | 0.18 |
| sec Amide | 0.29 | 0.29 | 0.39 | 0.27 | 0.35 | 0.06 | 0.27 | | 1.63 | 0.03 |
| tert. Amide | 0.18 | 0.23 | 0.26 | 0.22 | 0.10 | 0.02 | 0.13 | | 1.49 | 0.48 |
| imide/amide ratio | 1:1 | 1:1 | 2:3 | 2:1 | 5:4 | 8:1 | 2:1 | | 1:5 | 1:6 |

The IR carbonyl peak data in the above table confirm that the compounds are uncyclised materials, by contrast with the macrocyclic compounds of U.S. Pat. No. 5,478,367, each of which had four IR peaks between 1900 and 1500 $cm^{-1}$ (see Column 9, lines 13 to 21 of U.S. Pat. No. 5,478,367).

For use in preparing additive concentrate compositions and test fuel formulations, the dispersant additive test materials of Table 2 were diluted to an active matter concentration of 27% w by addition of "SHELLSOL R" (Trade Mark) solvent. "SHELLSOL R" solvent is an aromatic hydrocarbon solvent (74% aromatic) of boiling range 205 to 270° C. and average molecular weight 156. Treat rates in diesel fuels of the resulting dispersant solutions of 200 ppmw and 250 ppmw then correspond respectively to 54 ppmw and 68 ppmw of active matter.

Additive concentrate compositions for low sulphur diesel fuel were prepared by mixing (A) 200 parts by weight or (B) 250 parts by weight (pbw) of the above dispersant solutions with 300 pbw of 2-ethylhexyl nitrate (EHN) ignition improver, 5 pbw of an anti-rust agent, 5 pbw of an antifoaming agent, 5 pbw of a dehazer, 100 pbw of an alcohol solvent and 100 pbw of a lubricity additive.

The specific anti-rust agent used was a hydroxypropyl ester of tetrapropenyl succinic acid (propane-1,2-diol semiester of tetrapropenyl succinic acid) (c.f Example IV of UK Patent 1,306,233).

The antifoaming agent was a silicone antifoam additive sold by OSi Specialties (UK) Ltd, Harefield, UK under the trade designation "SAG TP-325" ("SAG" is a trade mark).

The base fuels employed were as follows:

| | Low-sulphur fuel | High-sulphur fuel |
|---|---|---|
| Density (kg/l) at 15° C. (ASTM D 4052) | 0.827 | 0.853 |
| Sulphur (ppmw) (IP 373) | 375 | 1800 |
| Distillation. degrees C (ASTM D 86) | | |
| IBP | 155.5 | 174 |
| 10% | 192.5 | 226 |
| 20% | 210.5 | 249 |
| 50% | 269 | 286 |
| 90% | 343 | 340 |
| 95% | 356 | 355 |
| FBP | 365 | 367 |
| Cetane No. (ASTM D 613) | 51.7 | 50.0 |

Examples 1 and 2

Steady-state injector nozzle fouling tests were performed according to the following method, employing a four cylinder VW Passat AAZ 1.9 TD (turbo diesel) IDI (indirect injection) diesel engine of 1896 cc displacement, equipped with a Bosch fuel injection system employing injector nozzles of type DNO SD 308.

In this test method, the same injector nozzles were used for engine warm-up as for the steady-state deposit accumulation stage. New nozzles, cleaned with n-heptane, were used for each test.

The engine was warmed up at 1500 rpm engine speed and 25 Nm dynamometer load for 20 minutes. The engine speed was then raised to 2000 rpm and the dynamometer load was increased to 90 Nm over 15 seconds, and the engine was run at that speed and load for 3 hours.

A fouling index was generated from measurements of air flow through the injector nozzles, assessments being made on the new nozzles, before the test (Flow Clean), and afterwards on the fouled nozzles (Flow Fouled). Air flow was measured in a Ricardo air-flow rig according to ISO 4010, measurements being recorded at needle lifts of 0.1, 0.2 and 0.3 mm, with a vacuum pressure 600 mBar (60.000 Pa).

Build up of deposits in the nozzles causes a reduction in measured air flow, and degree of nozzle fouling (F) was calculated as follows:

$$F = \frac{\text{Flow Clean} - \text{Flow Fouled}}{\text{Flow Clean}} \times 100$$

A fouling number for one nozzle was calculated by averaging the three values of F obtained at the three different needle lifts. The fouling index (FI) was obtained by averaging the fouling numbers from all four nozzles.

Tests were performed on low-sulphur fuel formulations as described above, containing 200 ppmw and 250 ppmw of dispersant solution of test material 1 (Examples 1 and 2), and for comparison purpose of material Comp. A (Comparative Examples I and II). Comparative tests were also performed on high-sulphur fuel formulations as described above, containing 200 ppmw and 250 ppmw of dispersant solution of test material 1 (Comparative Examples III and IV) and of material Comp. A (Comparative Examples V and VI). Values for base fuel are given as Comparative Examples VII and VIII.

Results of these tests are given in Table 3 following

| Example | Dispersant Additive Test Material | Treat Rate (ppmw) | Base Fuel | FI (%) |
|---|---|---|---|---|
| 1 | 1 | 250 | LS | 12 |
| 2 | 1 | 200 | LS | 15 |
| Comp. I | Comp. A | 250 | LS | 24 |
| Comp. II | Comp. A | 200 | LS | 31 |
| Comp. III | 1 | 250 | HS | 19 |
| Comp. IV | 1 | 200 | HS | 22 |
| Comp. V | Comp. A | 250 | HS | 22 |
| Comp. VI | Comp. A | 200 | HS | 26 |
| Comp. VII | — | — | LS | 34 |
| Comp. VIII | — | — | HS | 37 |

In the tests Comp. III to Comp. VI, the F1 values as between Comp. III and Conip. V and Comp. IV and Comp. VI can be seen to be essentially similar to one another. Comp. III and Comp. IV correspond to the fuels described on page 5 lines 28 to 52 of UK Patent Specification No. 960,493, wherein a polyisobutenyl mono-succinimide derived from PIB of Mn 950 and TEPA as amine was tested at a concentration of 200 ppmw in a high-sulphur fuel of cetane number 36 and sulphur content 0.5% (5000 ppmw).

It should be noted that, when dispersant additive Comp. A was used in low-sulphur diesel fuel, F1 was greater than when it was used in high-sulphur diesel fuel.

Surprisingly, when dispersant additive 1 was used in low-sulphur diesel fuel, not only was F1 very much lower than when it was used in high-sulphur diesel fuel, but the value of F1 for dispersant additive 1 was only half that for Comp. A.

Examples 3 and 4

Following the procedure of Examples 1 and 2, a range of tests was effected on low-sulphur fuel formulations containing individually 250 ppmw of the test materials 1 and 2 and comparative test material Comp. A, Comp. D, Comp. E, and Comp. G, and 370 ppmw of comparative test material Comp. B and Comp. C. Results are given Table 4 following:

TABLE 4

| Example | Dispersant Additive Test Material | Treat rate (ppmw) | PIB $M_n$ | Amine | Coupling ratio-intake (PIBSA: amine) | FI (%) |
|---|---|---|---|---|---|---|
| 3 | 1 | 250 | 950 | TEPA | 1:1.45 | 12 |
| 4 | 2 | 250 | 950 | TEPA | 1:1 | 12 |
| Comp. I | Comp. A | 250 | 950 | TEPA | 1.5:1 | 24 |
| Comp. IX | Comp. B | 370 | 950 | TEPA | 2:1 | 28 |
| Comp. X | Comp. C | 370 | 950 | DAP | 1:1.4 | 25 |
| Comp. XI | Comp. D | 250 | 780 | TEPA | 1:1.1 | 22 |
| Comp. XII | Comp. E | 250 | 570 | TEPA | 1:1.2 | 19 |
| Comp. XIII | Comp. G | 250 | 1300 | TEPA | 1:1 | 26 |
| Comp. VII | — | — | 1300 | — | — | 34 |

From the above table it can readily be seen, by comparison of Examples 3 and 4 with Comp XI, Comp. XII and Comp. XIII that for test materials which are similar except for differences in PIB Mn, the materials of the invention, of PIB Mn 950, are very significantly superior to those of PIB Mn 780 or lower or of PIB Mn 1300.

Similarly, by comparison of Examples 3 and 4 with Comp. I and Comp. IX, it can be seen that results for the dispersant additives of the invention, which have low coupling ratios, were very significantly superior to otherwise similar materials wherein the coupling ratio (PIBSA:amine) is 1.5:1 or 2:1.

Furthermore, by comparison of Examples 3 and 4 with Comp. X, it can be seen that dispersant additives of the invention were very significantly superior to otherwise similar material which was formed by reaction with an amine of different structure, viz. 3-dimethyl-aminopropylamine.

Examples 5 and 6

Additive concentrate compositions were prepared as described about except that different quantities of the dispersant solutions were used, 300 pbw of "SHELLSOL R" solvent was used in place of the 100 pbw alcohol solvent, the antifoaming agent was a silicone antifoam agent sold by Th. Goldschmidt A. G., Essen, Germany, under the trade designation "TEGOPREN 5851" ("TEGOPREN" is a trade mark), and the lubricity agent was a fatty acid dimer based material available ex Ethyl Petroleum Additives Inc., St. Louis, USA under the trade designation "HITEC E580" ("HITEC" is a trade mark).

Test fuel formulations were prepared on the same basis as above, using the low sulphur fuel LS as base fuel.

Using the resulting fuels, steady-state injector nozzle fouling tests were performed using a Fiat IDI 1929 cc. type 149 A1.000, diesel engine as used in Fiat Regata diesel automobiles, equipped with a Bosch injector system employing injector nozzles of type DN 125D 1750.

The engine was warmed up at 1500 rpm engine speed and 25 Nm dynamometer load for 20 mins. Injector nozzles were then changed to test nozzles.

The engine was then run at 2700 rpm and 75 Nm for 8.5 hours, after which the engine was switched off. Coolant oil/water temperatures were maintained at 90≦4° C.

Performance of each diesel fuel was assessed qualitatively by air-flow measurement of fouling levels produced in the engine's injector nozzles The nozzles, of type Bosch DN 12 SD 1750, were placed in a Ricardo air-flow rig according to ISO 4010, and air-flow measurements were recorded at needle lifts of 0.2, 0.2 and 0.3 mm, with a vacuum pressure 600 m Bar (60,000 Pa).

Fouling Index values were derived from the air-flow measurements by the calculation method described for Examples 1 and 2.

Results of these tests are given in Table 5 following, in which the values given in ppmw for treat rate also represent the parts by weight used in the additive concentrate compositions.

TABLE 5

| Example | Dispersant Additive Test Material | Treat rate (ppmw) | PIB $M_n$ | Amine | Coupling ratio-intake (PIBSA: amine) | FI (%) |
|---|---|---|---|---|---|---|
| 5 | 1 | 370 | 950 | TEPA | 1:1.45 | 2.4 |
| 6 | 3 | 370 | 884 | DETA | 1:1.95 | 0.6 |
| Comp. XIV | Comp. A | 250 | 950 | TEPA | 1.5:1 | 28 |
| Comp. XV | Comp. F | 370 | 350 | DETA | 1:1.4 | Stuck needles |
| Comp. XVI | — | — | — | — | — | 56.6 |

In these tests it can be seen that excellent results there obtained for the test dispersant additive test materials of the invention. Comp. XIV, which is similar to Example 5 except for the difference in coupling ratio, gave markedly inferior results, and Comp XV, which is similar to Example VI except for its lower PIB Mn of 350, resulted in such severe nozzle fouling that the injector needles stuck in the nuzzles.

What is claimed is:

1. A fuel oil composition comprising a major amount of a liquid hydrocarbon middle distillate fuel oil having a sulphur concentration of at most 0.05% by weight, and a minor proportion of a dispersant additive obtained by reacting, in a molar ratio A:B in the range 4:3 to 1:10, (A) a polyalkenyl derivative of monoethylenically unsaturated $C_4$–$C_{10}$ dicarboxylic acid material in which the number average molecular weight (Mn) of the polyalkenyl chain is in the range from 850 to 1150 with (B) a polyamine of general formula $$H_2N(CH_2)_m—[NH(CH_2)_m]_n—NH_2 \quad (1)$$

wherein m is in the range from 2 to 4 and n is in the range from 1 to 3.

2. The fuel oil composition of claim 1 wherein the polyalkenyl chain is derived from a polymer of at least one $C_2$–$C_5$ monoolefin.

3. The fuel oil composition of claim 2 wherein the monoolefin is isobutylene.

4. The fuel oil composition of claim 2 wherein the amount of dispersant additive is in the range of from 10 to 400 ppmw active matter based on total composition.

5. The fuel oil composition of claim 1 wherein the amount of dispersant additive is in the range of from 10 to 400 ppmw active matter based on total composition.

6. The fuel oil composition of claim 1 wherein the amount of dispersant additive is in the range of from 40 to 200 ppmw active matter based on total composition.

7. The fuel oil composition of claim 1 which additionally contains a lubricity additive in an amount in the range from 50 to 500 ppmw based on total composition.

8. A process for the preparation of the fuel oil composition of claim 1 which comprises admixing the dispersant additive or an additive concentrate containing the dispersant additive with the fuel oil.

9. A method of operating a compression-ignition engine which comprises introducing into the combustion chambers of said engine the fuel oil composition of claim 1.

* * * * *